US006322068B1

(12) United States Patent
Iemura et al.

(10) Patent No.: US 6,322,068 B1
(45) Date of Patent: Nov. 27, 2001

(54) SHEET DISCHARGE MECHANISM FOR AN INK JET PRINTER

(75) Inventors: Hirotoshi Iemura; Atsushi Ueda, both of Nara; Hajime Horinaka, Kashiba; Masaharu Kimura, Daito; Norihiro Ochi, Sakurai; Shunichi Hayashiyama, Nara, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/498,362

(22) Filed: Feb. 4, 2000

(30) Foreign Application Priority Data

Feb. 23, 1999 (JP) ..... 11-045078

(51) Int. Cl.[7] ..... B65H 29/38

(52) U.S. Cl. ..... 271/177; 271/188; 400/185

(58) Field of Search ..... 101/416.1, 419; 400/595, 596, 185; 347/102, 104; 271/188, 207, 220, 177, 306, 213, 218; 414/793.9, 794, 794.2

(56) References Cited

U.S. PATENT DOCUMENTS

| | | | | |
|---|---|---|---|---|
| 4,844,633 | * | 7/1989 | Greenberg | 400/120 |
| 5,409,209 | * | 4/1995 | Nakamura et al. | 271/271 |
| 5,890,822 | * | 4/1999 | Saikawa et al. | 400/647.1 |
| 5,927,877 | * | 7/1999 | Kelly et al. | 400/625 |
| 6,148,727 | * | 11/2000 | Parthasarathy et al. | 101/417 |

FOREIGN PATENT DOCUMENTS 691861 4/1994 (JP) .

* cited by examiner

*Primary Examiner*—Ren Yan
*Assistant Examiner*—Kevin D. Williams
(74) *Attorney, Agent, or Firm*—Birch, Stewart, Kolasch & Birch, LLP

(57) ABSTRACT

A sheet with an image formed thereon by an ink jet mechanism is held over the second sheet output tray. Then the sheet being held on the second sheet output tray is pushed out in the direction of discharge of the sheet by means of a rotating sheet discharge arm so that the sheet drops onto the first sheet output tray.

7 Claims, 9 Drawing Sheets

SHEET DISCHARGE MECHANISM FOR AN INK JET PRINTER

BACKGROUND OF THE INVENTION (1) Field of the Invention

The present invention relates to a sheet discharge mechanism provided for an ink jet printer for forming a designated image on a sheet of paper with ink ejected from an ink head.

(2) Description of the Prior Art

In an ink jet printer in which an image is formed on a sheet of paper with ejected ink from an ink head, the sheets with images formed with ink are discharged and stacked one over another on the sheet output tray. Therefore, when images are recorded continuously on a multiple number of sheets, a sheet having an image formed with ink is laid over the previous one before its ink dries so that the sheets may be stained or the image of ink may be disrupted by contact of the undried sheet. To avoid this, continuous image forming may be performed at intervals of a time which allows for drying of the ink on the sheet. However, drying of the ink on the sheet usually needs about 40 to 60 seconds, which makes high-speed image forming impossible.

In order to solve this problem, there has been a known printer inside which a drying device for drying the ink of the image formed on the paper is provided. However, provision of such a drying device therein makes the printer body bulky and degrades its economy.

Japanese Patent Application Laid-Open Hei 6 No.91861 discloses an ink jet printer in which when a sheet of paper having an image formed with ink is discharged from the printer body, the sheet being discharged is forcibly curved so as to be projected downward with respect to the direction perpendicular to the direction of discharge of the paper. In this way, curving the paper being discharged from the printer body can prevent the leading end, with respect to the direction of discharge, of the sheet from bending or drooping downwards so that the sheet can be kept horizontal until the sheet is discharged completely from the printer body. Therefore, the sheet being discharged can be held over the sheet previously discharged for an appropriate period of time and then stacked on the sheet output tray, thus making it possible to lengthen the time for the sheet to drop onto the sheet output tray and hence dry the ink on the previous sheet on the sheet output tray.

However, even with such a configuration in which a sheet is discharged from the printer body by being curved so as to be kept horizontal, there is a fear that the sheet may droop without being kept horizontal if the sheet itself has low rigidity and can be readily flexed so that the sheet may come in contact with the previous sheet on the sheet output tray and stain the sheet being discharged or disrupt the image on the previous sheet. This problem also occurs when a large sized sheet is used.

SUMMARY OF THE INVENTION

The present invention is to solve the above problem and it is therefore an object of the present invention to provide a sheet discharge mechanism for an ink jet printer, which can prevent occurrence of image disruption and sheet staining due to undried ink when sheets of a low rigidity or of a large size are stacked one over another on the sheet output tray.

The present invention has been devised in order to achieve the above object and the present invention is configured as follows:

In accordance with the first aspect of the present invention, a sheet discharge mechanism for an ink jet printer, includes: a first sheet output tray on which sheets with images formed with ink by the ink jet mechanism are sequentially stacked one over another; a second sheet output tray located above the first sheet output tray for holding the sheet with an image formed with ink by the ink jet mechanism; and a sheet dropping means for sequentially dropping the sheet held by the second sheet output tray onto the first sheet output tray.

In accordance with the second aspect of the present invention, the sheet discharge mechanism for an ink jet printer having the above first feature is characterized in that the second sheet output tray is configured so as to curve the sheet being held thereby in such a manner that the middle part of the sheet with respect to the direction perpendicular to the direction of discharge of the sheet is projected downward.

In accordance with the third aspect of the present invention, the sheet discharge mechanism for an ink jet printer having the above first feature is characterized in that the sheet dropping means includes a sheet discharge arm which is rotated so as to come into contact with the rear end of the sheet being held over the second sheet output tray and push it out from the second sheet output tray.

In accordance with the fourth aspect of the present invention, the sheet discharge mechanism for an ink jet printer having the above third feature is characterized in that the sheet discharge arm is configured so as to pass through a cutout portion defined in the second sheet output tray.

In accordance with the fifth aspect of the present invention, the sheet discharge mechanism for an ink jet printer having the above third feature is characterized in that the sheet discharge arm is rotated and stopped based on the operation of the ink head carriage which is moved reciprocatingly by the ink jet mechanism.

In accordance with the sixth aspect of the present invention, the sheet discharge mechanism for an ink jet printer having the above third feature is characterized in that the sheet discharge arm stores the energy for rotational force while it is being stopped.

DESCRIPTION OF THE PREFERRED EMBODIMENTS

Figure 1:
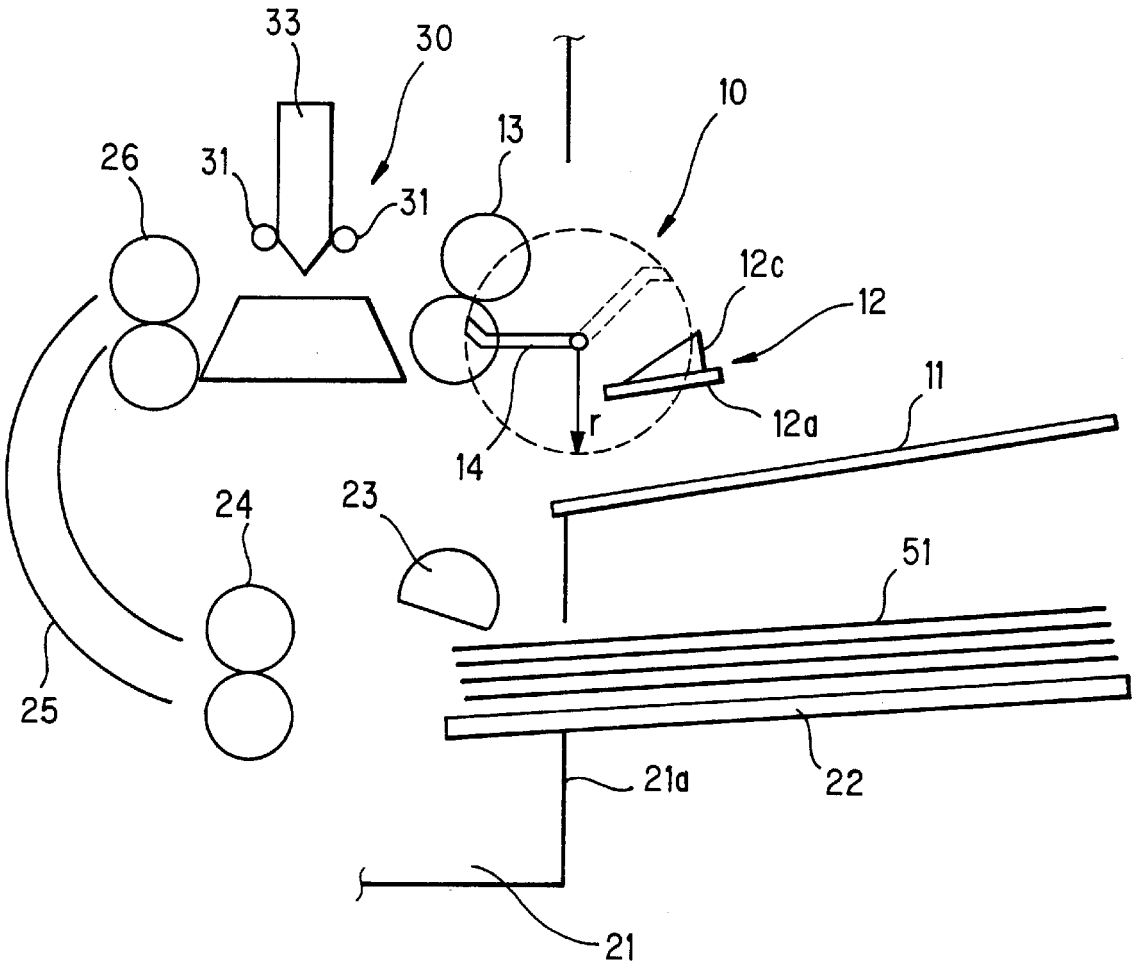
FIG. 1 is a schematic sectional view showing one example of an ink jet printer having a sheet discharge mechanism of the present invention.

The embodiment of the present invention will hereinafter be described with reference to the accompanying drawings. FIG. 1 is a schematic view showing the essential configuration of an ink jet printer having a sheet discharge mechanism of the present invention. This ink jet printer includes: a printer body 21 having an ink jet mechanism 30 therein. Arranged on one side 21*a* of printer body 21 is a sheet feed tray 22, on which sheets 51 to be imaged are stacked. Sheets 51 on sheet feed tray 22 are fed one by one by means of a pickup roller 23 into the nip between a pair of sheet feed rollers 24, arranged above and below, inside printer body 21. The sheet 51 fed into sheet feed rollers 24 is conveyed through a sheet conveyance passage 25 to reach a pair of PS rollers 26, arranged above and below. Then the sheet is conveyed intermittently to ink jet mechanism 30 at the predetermined timing.

Ink jet mechanism 30 includes: a pair of ink head carriage holding shafts 31 arranged in parallel with each other in the direction perpendicular to the feed direction of sheet 51; an ink head cartridge 32 (see FIG. 2) held by ink head carriage holding shafts 31; an ink head 33 which reciprocates along ink head carriage holding shafts 31. Ink head carriage 32 is made to move reciprocatingly in the direction perpendicular to the conveyed direction of sheet 51 when sheet 51 being conveyed intermittently by PS rollers 26 stops under ink head 33. During this reciprocating movement, ink is ejected onto sheet 51 so as to form an image corresponding to the image information. Thereafter, the sweep of ink head 33 and the intermittent conveyance of sheet 51 are repeated sequentially, so that a predetermined image is formed with ink onto sheet 51.

Figure 2:
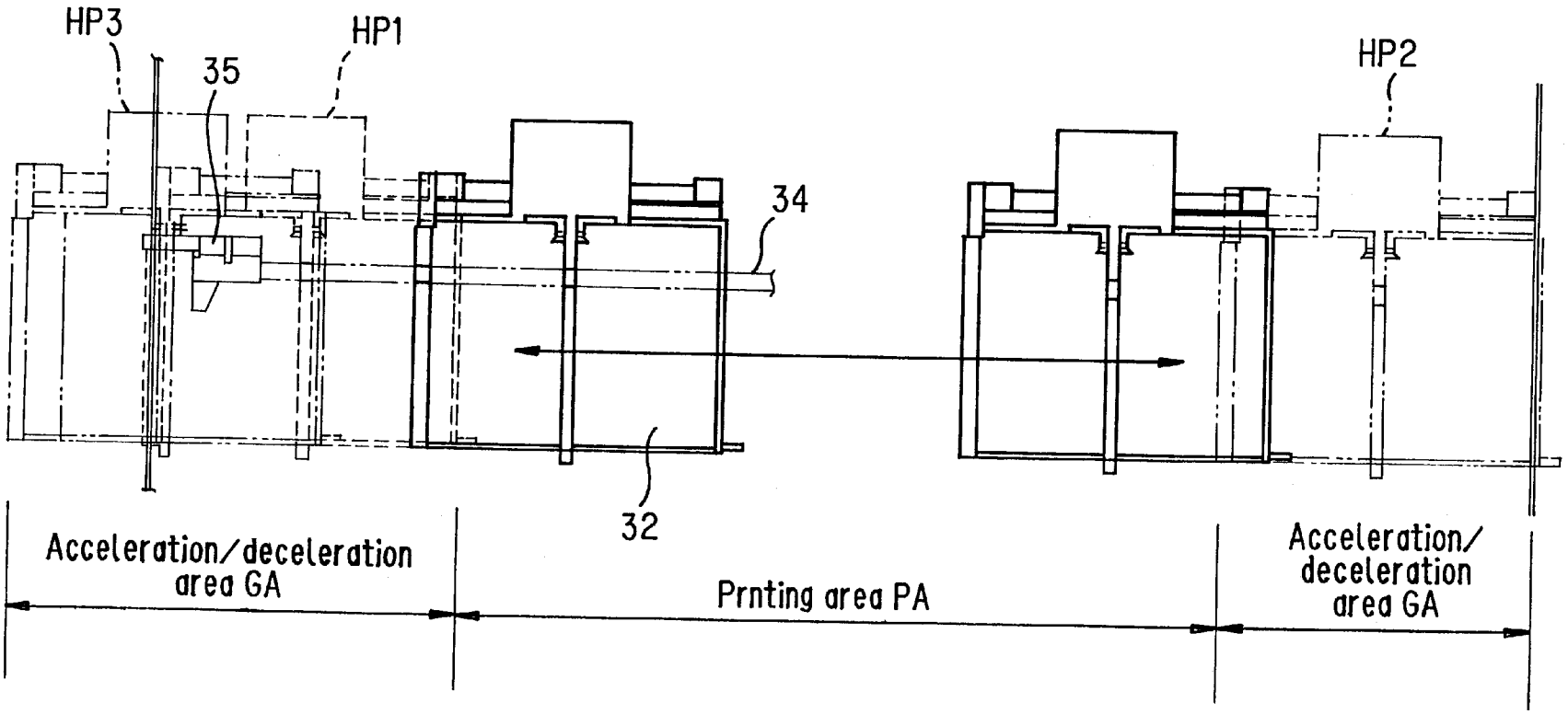
FIG. 2 is a schematic plan view for illustrating the essential parts of an ink jet mechanism provided in the ink jet printer.
Figure 3:
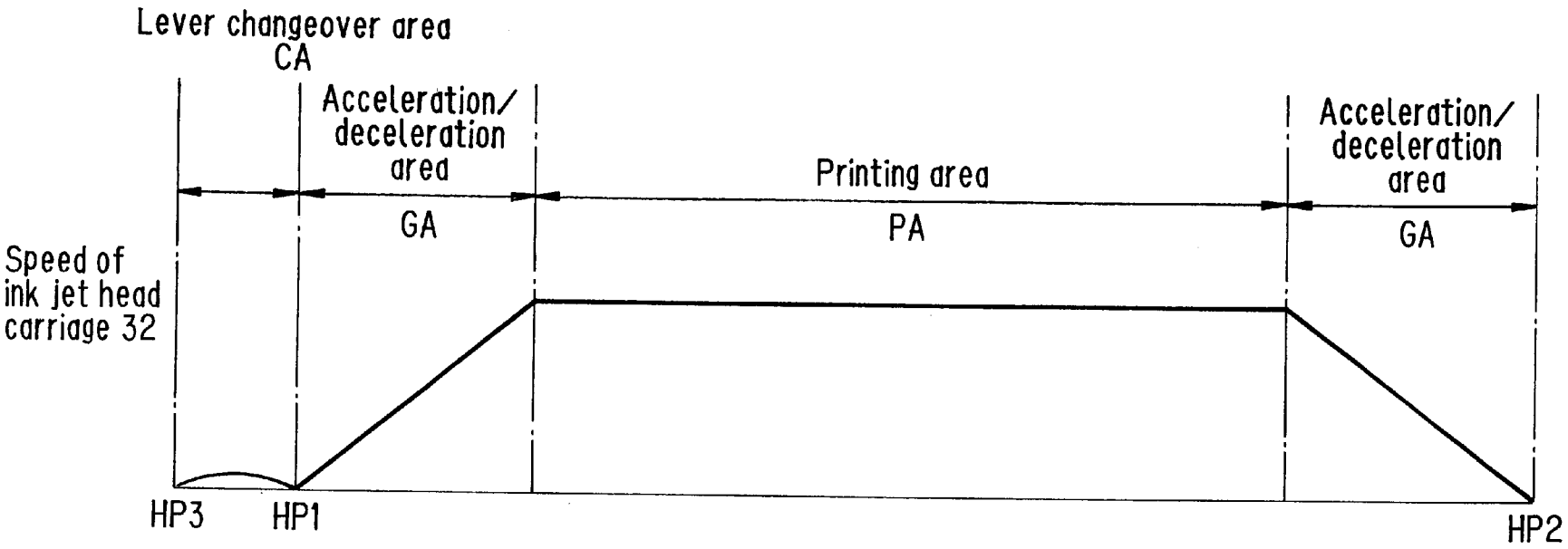
FIG. 3 is a chart for illustrating the operation of the ink jet mechanism.

FIG. 2 is a schematic plan view showing an ink jet mechanism 30. Ink head carriage 32 is usually set at rest at a first home position HP1 located on one side of sheets 51 to be conveyed or on one side part of printer body 21 and is caused to move from first home position HP1 to the other side part of printer body 21 along a guide shaft 34, as shown in FIG. 3. Ink head carriage 32 set at first home position HP1 is accelerated in the acceleration/deceleration area GA and is moved at a constant speed in the printing area PA. During travel of ink head carriage 32 through the printing area PA, ink is ejected from ink head 33 in accordance with image data to thereby form a designated image on the sheet 51 below.

Ink head carriage 32 having traveled at a uniform speed through the printing area PA is caused to decelerate in the acceleration/deceleration area GA and then is stopped at a second home position HP2 located on the other side part of printer body 21. Ink head carriage 32 set at second home position HP2 is thereafter accelerated in the acceleration/deceleration area GA toward first home position HP1 and passes through the printing area PA at a constant speed. Then it is decelerated in acceleration/deceleration area GA and is stopped at first home position HP1. Also in this case, during travel of ink jet carriage 32 through the printing area PA, ink is ejected from ink head 33 in accordance with image data to thereby form a designated image on the sheet 51 below. In this way the same sequence of operations is repeated to complete a designated image onto sheet 51.

After ink head carriage 32 completes such an image forming operation, it is driven so as to pass through a lever changeover area CA and slid into a third home position HP3 after the passage of lever changeover area CA. Then, ink head carriage 32 is slid and positioned at first home position HP1 or second home position HP2.

As shown in FIG. 1, sheet 51 with a designated image formed by ink jet mechanism 30 is discharged by a pair of discharge rollers 13 arranged above and below in a sheet discharge mechanism 10 of the present invention, from the interior of printer body 21 onto second sheet output tray 12 and held thereon. Sheet 51 held on second sheet output tray 12 then is delivered to a first sheet output tray 11 by a sheet discharge arm 14 making up a sheet dropping means. Sheets 51 with images formed thereon are sequentially stacked onto first sheet output tray 11.

Figure 4:
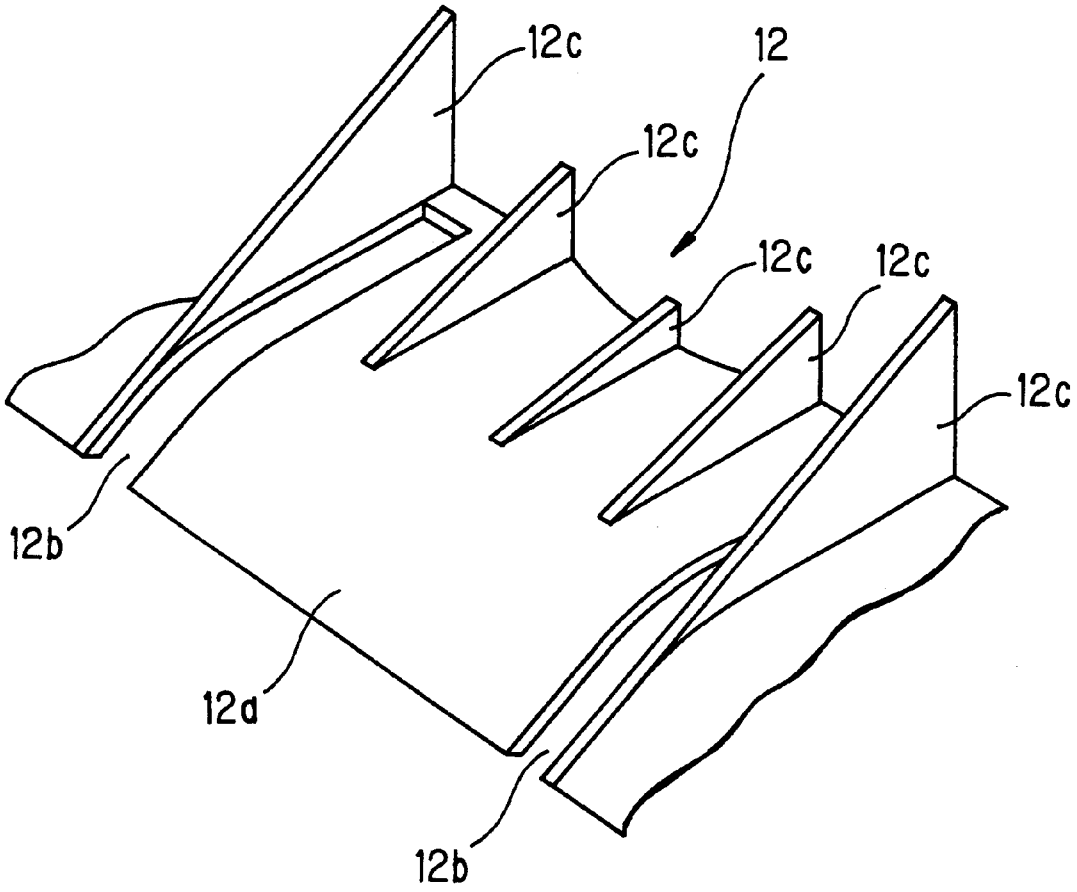
FIG. 4 is a perspective view showing part of the second sheet output tray provided for the sheet discharge mechanism of the present invention.

FIG. 4 is a schematic perspective view showing the essential part of second sheet output tray 12. This second sheet output tray 12 has a tray body 12*a* which is attached inclined upwards and sidewards with respect to the side panel 21*a* of printer body 21. This tray body 12*a* has a long side extending in the direction perpendicular to the direction of sheet 51 discharged by discharge rollers 13 while the side extending in the direction of discharge of sheet 51 is shorter than that of first sheet output tray 11 located below.

Second sheet output tray 12 has a pair of cutout portions 12*b*, each extending in the direction of discharge of sheet 51 and opening upward and downward and toward printer body 21. Each cutout portion 12*b* extends in proximity to the side edge of tray body 12*a* on the downstream side with respect to the conveyed direction of sheet 51.

A multiple number of guide portions 12*c* which are gradually raised towards the downstream side with respect to the conveyed direction of sheet 51 are formed on the upper surface of tray body 12*a* so as to extend in the conveyed direction of sheet 51. These guide portions 12*c* are configured so that the guide portions 12*c* that are located on both of the sides or most distant from the center with respect to the direction perpendicular to the direction of discharge of sheet 51 have the maximum amount of projection upwards while the projected amount of the guide portion 12*c* that is located at the center with respect to the direction perpendicular to the direction of discharge of sheet 51 is minimized. Therefore, sheet 51 being discharged by discharge rollers 13 is guided by these guide portions 12*c* while its downstream side with respect to the direction of conveyance is inclined upwards and curved so that the middle part with respect to the direction perpendicular to the direction of discharge is projected downwards forming an arc.

Figure 5:
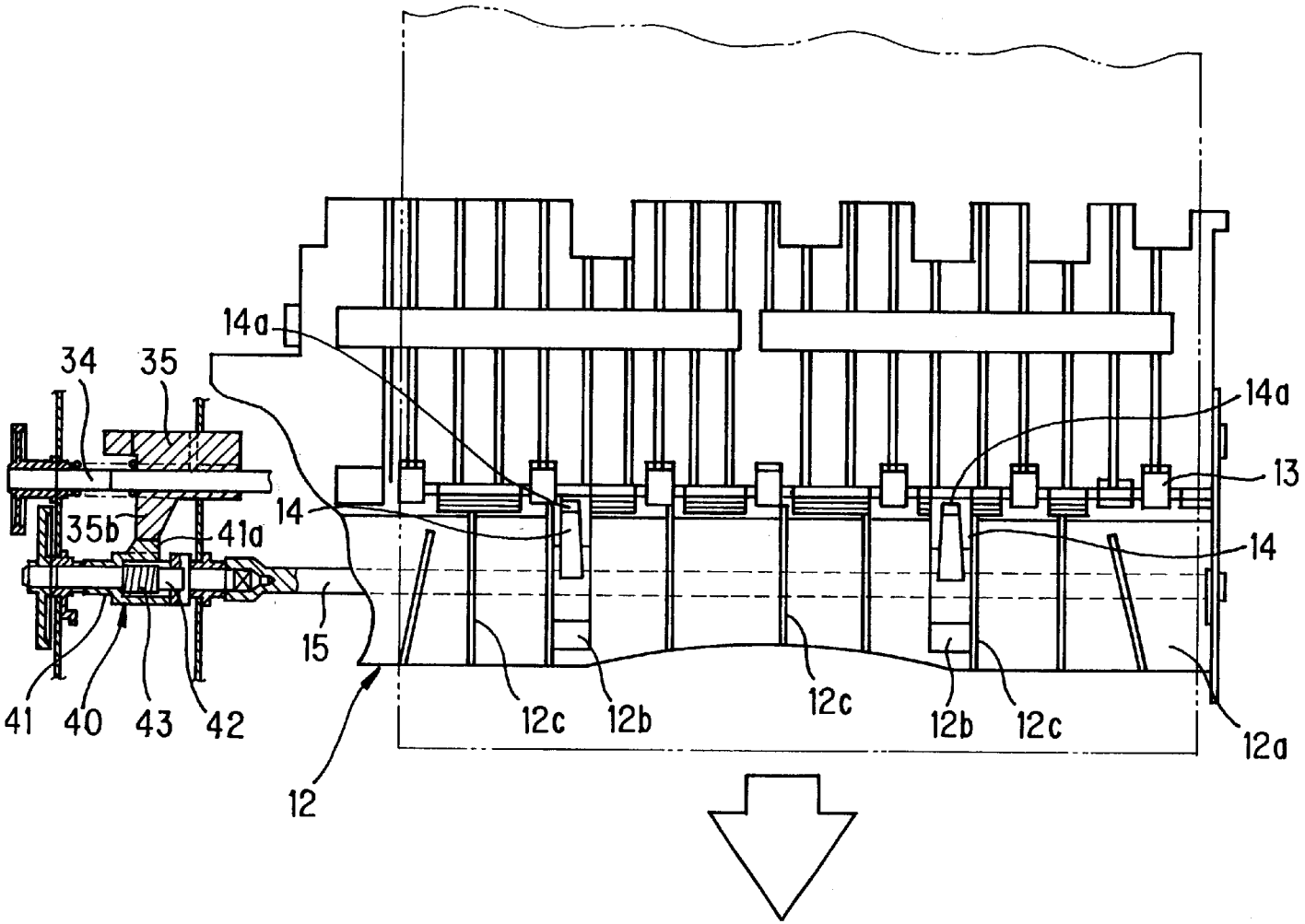
FIG. 5 is a schematic plan view showing the sheet discharge mechanism of the present invention.
Figure 6:
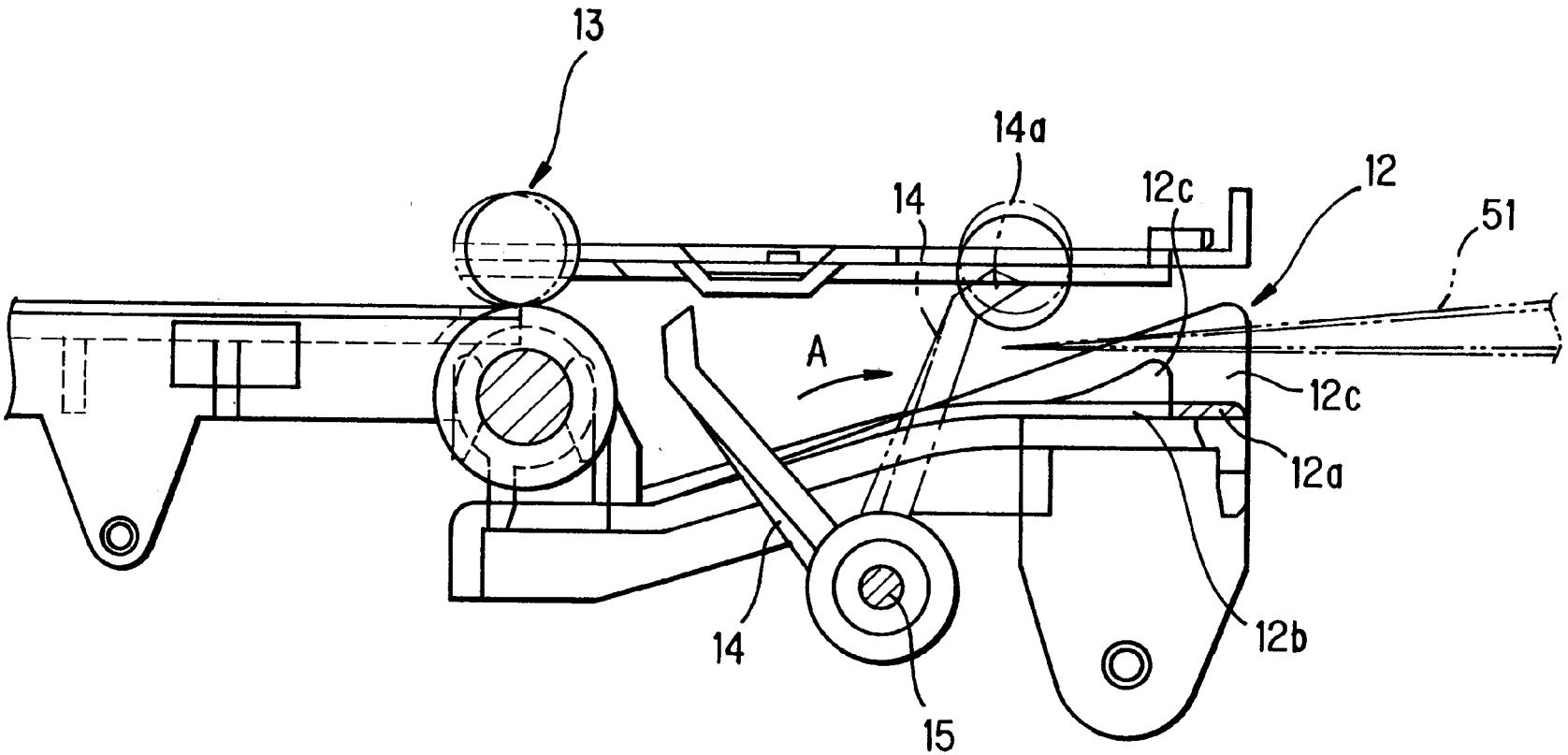
FIG. 6 is a schematic side view showing the sheet discharge mechanism.

FIG. 5 is a schematic plan view showing sheet discharge mechanism 10 and FIG. 6 is a schematic side view of the same. An arm rotating shaft 15 is provided so as to be rotatable below second sheet output tray 12 in the direction perpendicular to the conveyed direction of sheet 51, that is, in parallel with guide shaft 34 in ink jet mechanism 30. A pair of sheet discharge arms 14 are attached at their proximal ends to this arm rotating shaft 15 so that these arms correspond to respective cutout portions 12*b* of sheet output tray 12. As arm rotating shaft 15 is rotated, each sheet discharge arm 14 rotates above arm rotating shaft 15 in the direction of discharge of sheet 51 and passes through cutout portion 12*b* of sheet output tray 12. The distal end of each sheet discharge arm 14 is bent above arm rotating shaft 15 in the rotational direction of sheet discharge arm 14, forming a kicking portion 14*a*. This kicking portion 14*a* passes through a position closer to the edge of cutout portion 12*b* in second sheet output tray 12 on the front side with respect to the direction of discharge of sheet 51.

One end of arm rotating shaft 15 is positioned so as to oppose guide shaft 34 in the clutch changeover area CA. Connected to the end of arm rotating shaft 15 positioned in the clutch changeover area CA is an arm drive shaft 17 by way of sheet discharge clutch 40. A rotational force from a drive source provided in printer body 21 is transmitted to arm drive shaft 17, which in turn is transmitted to each of sheet discharge arms 14 by way of sheet discharge clutch 40.

Arranged at the end of guide shaft 34 opposing sheet discharge clutch 40 in clutch changeover area CA is a slider 35 which switches sheet discharge clutch 40 between the state in which the rotation of arm drive shaft 17 is transmitted to arm rotating shaft 15 and the state in which the rotation of arm drive shaft 17 will not be transmitted to arm rotating shaft 15.

Figure 7:
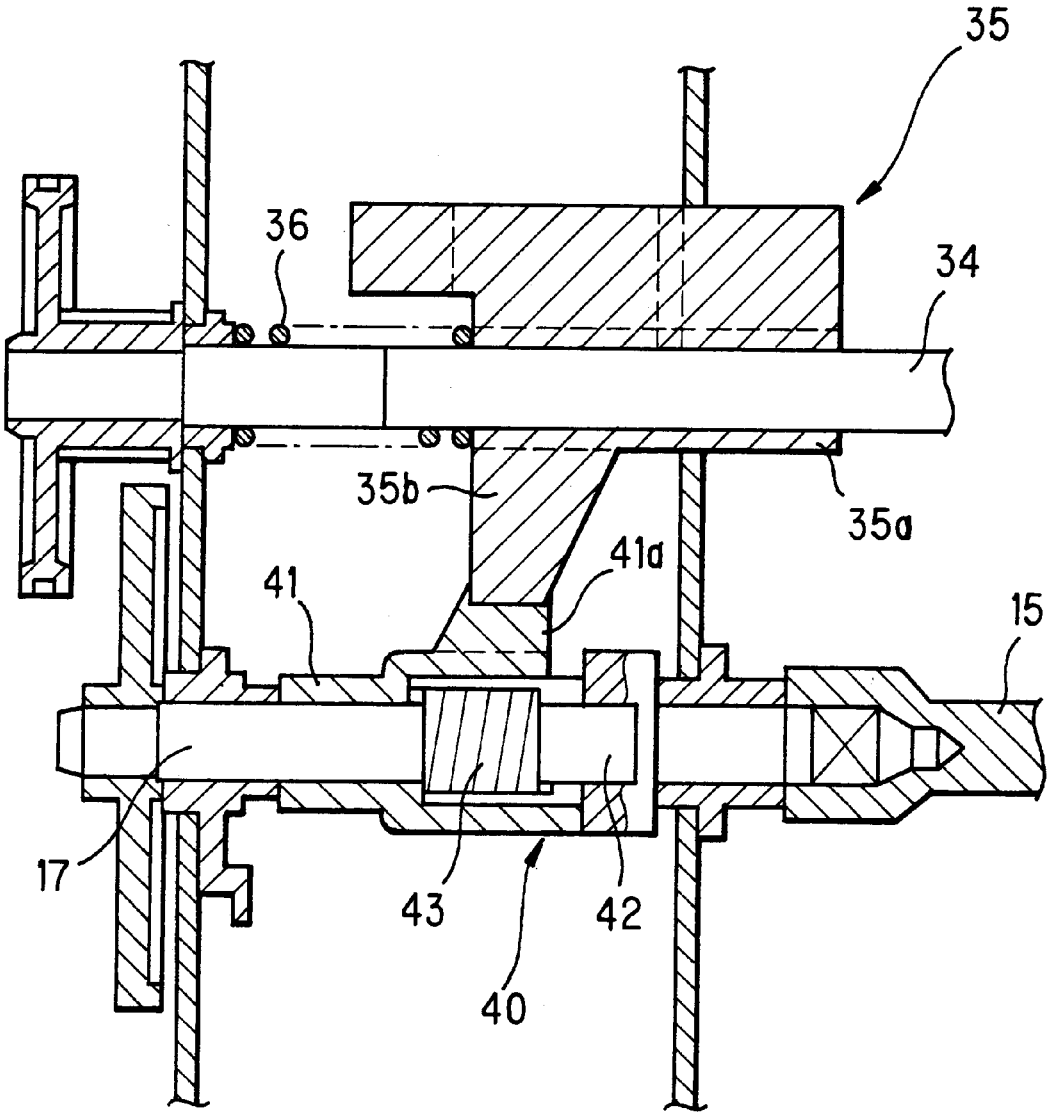
FIG. 7 is a sectional view showing a slider and a sheet discharge clutch provided for the sheet discharge mechanism.

FIG. 7 is a sectional view showing sheet discharge clutch 40 and slider 35. Slider 35 includes a cylindrical sliding body 35*a* fitted on the end of guide shaft 34 so as not to rotate with respect to guide shaft 34 but be axially slidable and a lever portion 35*b* which is projected radially outwardly from slider body 35*a* toward sheet discharge clutch 40. Sliding body 35*a* is urged toward the printing area PA, the central part of guide shaft 34, by a compression spring 36 fitted on guide shaft 34.

Slider 35 is usually arranged in proximity to the print area PA within the clutch changeover area CA, by virtue of compression spring 36. When ink head carriage 32 is slid whilst being guided by guide shaft 34 into clutch changeover area CA, the slider is pushed by the side wall of ink head carriage 32 and slid along guide shaft 34 toward third home position HP3, opposing the pressing force of compression spring 36.

Sheet discharge clutch 40 includes: a cylindrical clutch body 41 mated with arm drive shaft 17; a transmission shaft 42 coupled coaxially with arm rotating shaft 15 on which sheet discharge arms 14 are attached; and a coil spring 43 for transmitting the rotational force of clutch body 41 to transmission shaft 42.

Clutch body 41 is mated at its one end with the end part of arm drive shaft 17 so that it will rotate integrally with arm drive shaft 17. The other end of clutch body 41 Is projected further from the end of arm drive shaft 17 and has an engaging portion 41*a* projected radially outwardly from the peripheral surface thereof. The distal end of this engaging portion 41*a* is adapted to engage the distal end of lever portion 35*b* when slider 35 provided on guide shaft 34 is not urged by ink head carriage 32 but is placed under resilient force of compression spring 36 and is adapted to become disengaged from lever portion 35*b* of slider 35 when slider 35 is pushed and slid to third home position HP3 by ink head carriage 32.

Clutch body 41 is adapted to rotate integrally with arm drive shaft 17. However, the engagement of engaging portion 41*a* with lever portion 35*b* of slider 35 keeps the clutch body from rotating. When engaging portion 41*a* of clutch body 41 is disengaged from lever portion 35*b* of slider 35, clutch body 41 rotates integrally with arm drive shaft 17.

In clutch body 41, a coil spring 43 is arranged coaxially with arm drive shaft 17 in the interior of the end part with. engaging portion 41*a* thereon. One end of this coil spring 43 is attached to the end part of arm drive shaft 17 while the other end of coil spring 43 is attached to the end part of transmission shaft 42 which is attached coaxially with arm rotating shaft 15. Coil spring 43 transmits the rotation of arm drive shaft 17 to transmission shaft 42 so that transmission shaft 42 will rotate In the same direction as arm drive shaft 17. As transmission shaft 42 rotates, arm rotating shaft 15 integrated with transmission shaft 42 rotates in the same direction as arm drive shaft 17.

Figure 8:
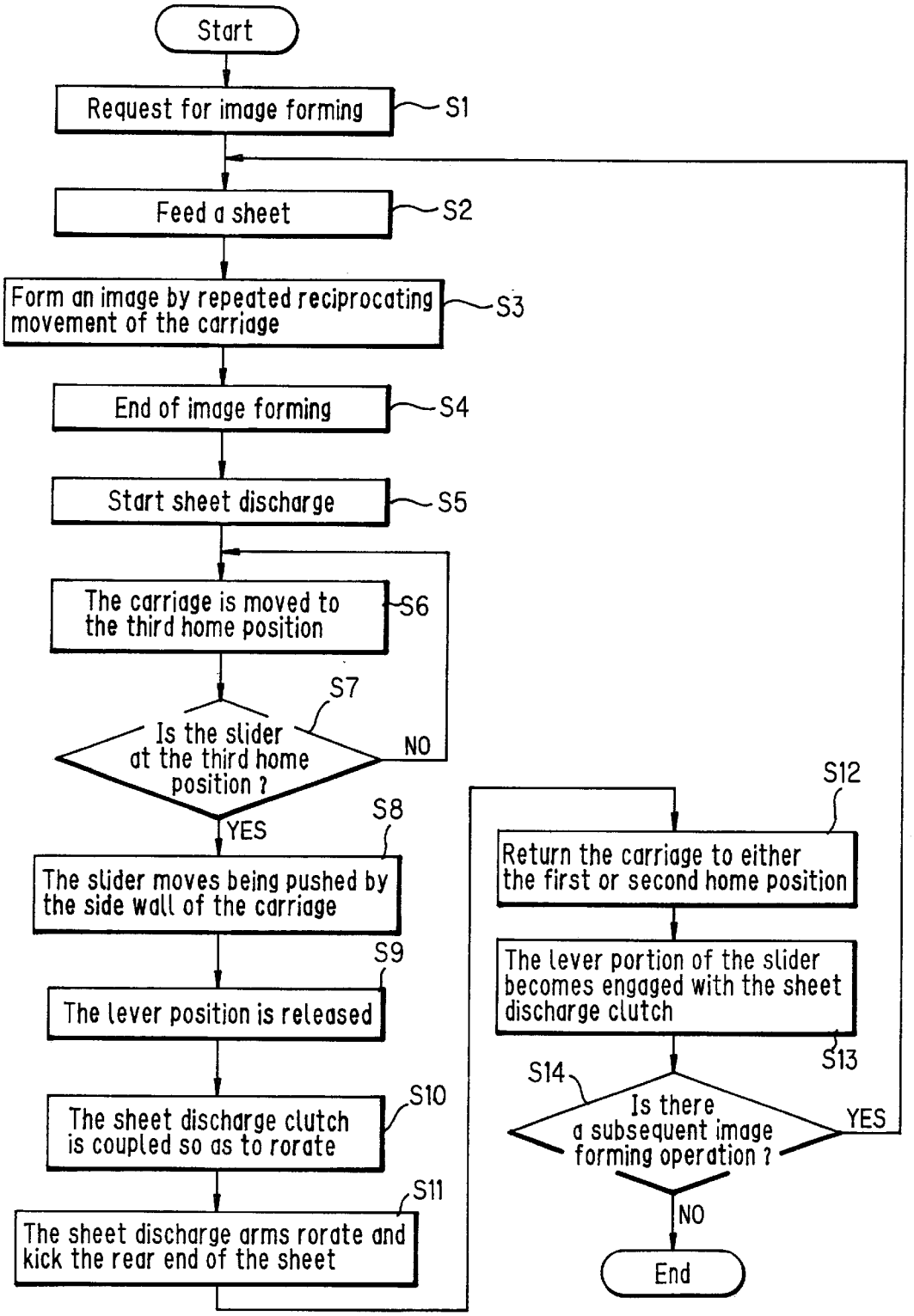
FIG. 8 is a flowchart for illustrating the operation of the ink jet printer shown in FIG. 1.

Now, the operation of the ink jet printer thus configured will be described with reference to the flowchart shown in FIG. 8. First, an instruction is given to the ink jet printer to form an image (c.f., step S1 in FIG. 8, the same hereinbelow), a sheet 51 on sheet feed tray 22 is picked up and conveyed by pickup roller 23 and sheet feed rollers 24 through sheet conveyance passage 25 inside printer body 21 to PS rollers 26. PS rollers 26 feeds sheet 51 intermittently at the predetermined timing to ink jet mechanism 30 (Step S2).

As sheet 51 is feed intermittently into ink jet mechanism 30, ink head carriage 32 reciprocates in synchronism with the stoppage of sheet 51. That is, while the ink head carriage moves through the printing area PA at a constant speed, ink is ejected onto the sheet 51 arranged under the ink head carriage in accordance with image data, thus forming an image (Step S3). In this way, ink head carriage 32 repeatedly reciprocates between first home position HP1 and second home position HP2 to complete the designated image forming for one sheet 51 (Step S4). Then, discharge of sheet 51 is started by sheet discharge mechanism 10 (Step S5) so that rotational forces are transmitted to sheet discharge rollers 13 and arm drive shaft 17. As sheet discharge rollers 13 rotate, the sheet 51 having an image formed thereon is discharged onto second sheet output tray 12. At this moment, arm drive shaft 17 receiving rotational force will not rotate because engaging portion 41*a* of sheet discharge clutch 40 is engaged with lever portion 35*b* of slider 35. Also in this case, the rotational force transferred to arm drive shaft 17 is stored in coil spring 43.

The sheet 51 being discharged onto second sheet output tray 12 is curved by means of guide portions 12*c* of second sheet output tray 12 so that its central portion is projected downward forming an arc with respect to the direction perpendicular to the direction of discharge of sheet 51. In this way, the sheet 51 with its section curved like an arc on second sheet output tray 12 with respect to the direction perpendicular to the direction of discharge of the sheet becomes hardened against droop in the direction of conveyance.

Thus, when sheet 51 being curved like an arc is completely discharged from printer body 21, sheet 51 is positioned so that the part other than the rear end is projected out from second sheet out put tray 12. In this case, sheet 51 is curved like an arc in the direction perpendicular to the direction of discharge. Therefore, the sheet can be held approximately horizontal with its rear end placed over second sheet output tray 12 without drooping.

Figure 9A:
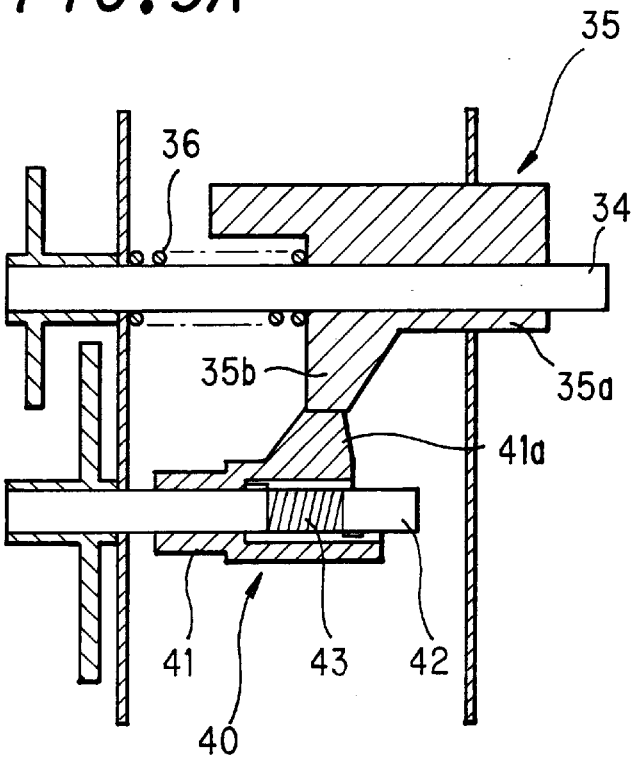
FIGS. 9A and 9B are schematic sectional views for illustrating the operations of the slider and the sheet discharge clutch, respectively.

When this state is established, ink head carriage 32 is slid toward third home position HP3 (Step S6). Before ink head carriage 32 shifts to third home position HP3, lever portion 35*b* of slider 35 has been engaged with engaging portion 41*a* of clutch body 41 in sheet discharge clutch 40, as shown in FIG. 9A. Therefore, arm drive shaft 17 to which rotational force is being transmitted will not be rotated, hence arm rotating shaft 15 and sheet discharge arm 14 also stand still without being rotated.

Figure 9B:
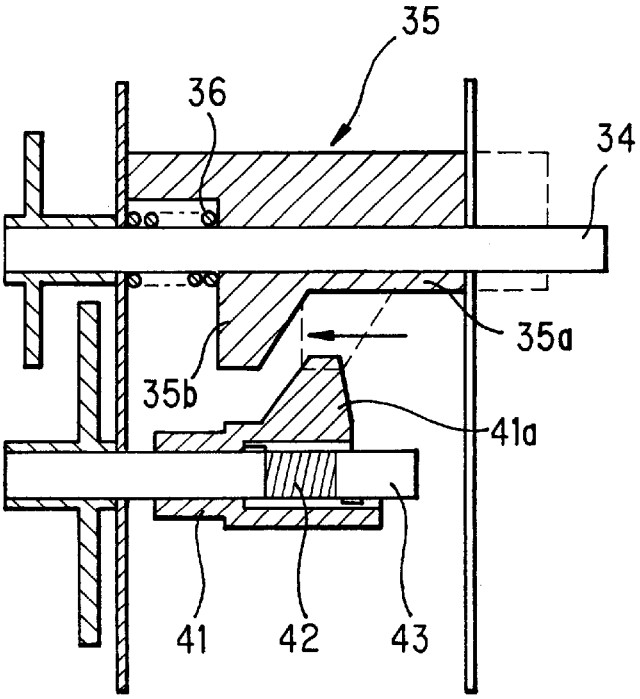

Thereafter, when ink head carriage 32 has been slid until it reaches third home position HP3 (Step S7), slider 35 is pushed by the side wall of ink jet cartridge 32 and slid toward third home position HP3 (Step S8). By this movement, as shown in FIG. 9B, lever portion 35*b* of slider 35 becomes disengaged from engaging portion 41*a* of clutch body 41 in sheet discharge clutch 40 (Step S9) so as to allow for free rotation of clutch body 41 integrated with arm drive shaft 17 to which drive force is being transmitted. Thus, arm drive shaft 17 is rotated (Step S10). The rotation of arm drive shaft 17 is transmitted to arm rotating shaft 15 by way of coil spring 43 and transmission shaft 42.

At this point, rotational force transferred to arm drive shaft 17 is stored in coil spring 43. Therefore, if clutch body 41 is allowed to rotate freely, coil spring 43 rotates transmission shaft 42 with the resilient force of rotation from the stored spring energy so that arm rotating shaft 15 integrated with transmission shaft 42 will rotate quickly. That is, the two sheet discharge arms 14 attached to arm rotating shaft 15 are rotated quickly in the direction of arrow A from the state indicated by two-dot chain line in FIG. 6.

As each sheet discharge arms 14 rotates downwards to corresponding cutout portion 12*b* in second sheet output tray 12, the tailing edge of sheet 51 located over second sheet output tray 12 is pushed by sheet discharge arms 14 in the direction of discharge of the sheet. When each sheet discharge arm 14 passes through corresponding cutout portion 12*b*, bent portion 14*a* formed in the distal end of each sheet discharge arm 14 kicks the rear end of sheet 51 in the direction of sheet discharge direction (Step S11). Sheet 51 held horizontally over second sheet output tray 12 drops onto first sheet output tray 11.

During this movement, each sheet discharge arm 14 passes through the side part of second sheet output tray 12, at a high speed because it is accelerated by the force from the stored energy in coil spring 43. Therefore, each sheet discharge arm 14 reliably kicks the rear end of sheet 51 sideward from above to thereby make sheet 51 drop onto first sheet output tray 11 in a reliable manner.

In this way, sheet 51 having a designated image formed with ink has been held on second sheet output tray 12 for an appropriate period of time and then is dropped onto first sheet output tray 11 and stacked thereon.

When the rotation of arm drive shaft 17 is transmitted to arm rotating shaft 15 by means of sheet discharge clutch 40 and ink head carriage 32 reaches third home position HP3, ink head carriage 32 is moved to first home position HP1 or second home position HP2 (Step S12). Then, slider 35 is slid by the resilient force of compression spring 36 so as to restore the initial state shown in FIG. 9A, in which lever portion 35*b* of slider 35 is engaged with engaging portion 41*a* of sheet discharge clutch 40 (Step S13) while arm drive shaft 17 and arm rotating shaft 15 stop rotating.

Thereafter, it is checked whether an image is formed for a next sheet 51 (Step S14). If an image needs to be formed for a next sheet 51, the above series of operations will be repeated.

In a case where continuous image forming is performed for a multiple number of sheets 51, after the first sheet 51 is dropped onto first sheet output tray 11 and has been stacked thereon the next sheet 51 is held on second sheet output tray 12 for an appropriate period of time and then drops onto first sheet output tray 11 and is stacked over the previous sheet. Therefore, the sheet 51 which dropped first onto first sheet output tray 11 has the ink dried thereon before the next sheet 51 is stacked thereon, thus making it possible to avoid ink staining over the subsequent sheet 51 or the image on previous sheet 51 from being disrupted.

In the sheet discharge mechanism of the ink jet printer of the present invention, the sheet having been image formed with ink is once held on the second sheet output tray and then is dropped on the first sheet output tray by the sheet dropping means. Therefore, there is no fear that the sheets will be stained with undried ink or the image on the sheet will be disrupted even if sheets of a large size or sheets of a low rigidity are used for continuous image forming.

What is claimed is:

1. A sheet discharge mechanism for an ink jet printer, comprising:

a first sheet output tray on which sheets with images formed with ink by an ink jet mechanism are sequentially stacked one over another;

a second sheet output tray located above the first sheet output tray for holding a sheet with an image formed with ink by the ink jet mechanism; and a sheet dropping means for sequentially dropping the sheet held by the second sheet output tray onto the first sheet output tray; said sheet dropping means including, a sheet discharge arm rotatable into contact with a rear end of the sheet being held over the second sheet output tray in order to push it out from the second sheet output tray, a clutch for facilitating rotation of the sheet discharge arm in a first position or stopping rotation in a second position thereof responsive to movement of a printhead carriage reciprocably movable by the ink jet mechanism during a printing cycle, and an energy-storing device storing energy for subsequently rotating the sheet discharge arm during a period when the clutch in said second position stops rotation of the discharge arm, and releases the stored energy to rapidly rotate the discharge arm when movement of the carriage causes the clutch to move to said first position to facilitate rotation of the discharge arm.

2. The sheet discharge mechanism for an ink jet printer according to claim 1, wherein the second sheet output tray includes means to curve the sheet being held thereby in such a manner that a middle part of the sheet with respect to the direction perpendicular to a direction of discharge of the sheet is projected downward.

3. The sheet discharge mechanism for an ink jet printer according to claim 1, wherein the second sheet output tray comprises a cutout portion the sheet discharge arm is configured so as to pass through the cutout portion defined in the second sheet output tray.

4. The sheet discharge mechanism of an ink jet printer according to claim 1 wherein the energy-storing device is a spring connected between a drive shaft assembly for the discharge arm, and said discharge arm, said spring winding up when the discharge arm is stopped by the clutch in the second position thereof, and unwinding to rotate the discharge arm when the clutch is in said first position.

5. A sheet discharge mechanism for an ink jet printer, comprising:

a first sheet output tray on which sheets with images formed with ink by the ink jet mechanism are sequentially stacked one over another;

a second sheet output tray located above the first sheet output tray for holding the sheet with an image formed with ink by the ink jet mechanism;

a sheet dropping means for sequentially dropping the sheet held by the second sheet output tray onto the first sheet output tray;

a plurality of guide portions, projected in a conveyed direction of the sheet, disposed in a sheet conveying area of said second sheet output tray; and a plurality of cutout portions disposed between said guide portions, characterized in that discharge arms pass through said cutout portions so as to push the sheets out from said second sheet output tray.

6. The sheet discharge mechanism for an ink jet printer according to claim 5, wherein each guide portion is so disposed that an amount of upward projection of each guide portion, disposed in a direction perpendicular to a direction of sheet discharge, is made greater on both sides than at a middle part thereof.

7. The sheet discharge mechanism for an ink jet printer according to claim 5 wherein said sheet dropping means includes:

a clutch for facilitating rotation of the sheet discharge arms in a first position or stopping rotation in a second position thereof responsive to movement of a printhead carriage reciprocably movable by the ink jet mechanism during a printing cycle, and an energy-storing device storing energy for subsequently rotating the sheet discharge arm during a period when the clutch in said second position s tops rotation of the discharge arm, and releases the stored energy to rapidly rotate the discharge arm when movement of the carriage causes the clutch to move to said first position to facilitate rotation of the discharge arms.

* * * * *